United States Patent [19]

Loerwald

[11] Patent Number: 4,807,367

[45] Date of Patent: Feb. 28, 1989

[54] CAN END CUTTING DEVICE

[75] Inventor: Terry L. Loerwald, Harvey, La.

[73] Assignee: Land and Marine Applicators, Inc., Jefferson County, La.

[21] Appl. No.: 61,454

[22] Filed: Jun. 15, 1987

[51] Int. Cl.[4] ..... B26F 1/44

[52] U.S. Cl. ..... 30/445; 30/367; 30/277; 30/446

[58] Field of Search ..... 30/277, 301, 302, 316, 30/367, 443–446

[56] References Cited

U.S. PATENT DOCUMENTS

| | | | |
|---|---|---|---|
| 951,890 | 3/1910 | Tremblay | 30/367 X |
| 1,223,485 | 4/1917 | Emery | 30/445 X |
| 1,790,439 | 1/1931 | Patermann | 30/445 X |
| 2,677,881 | 5/1954 | Anderson | 30/445 |

FOREIGN PATENT DOCUMENTS

| | | | |
|---|---|---|---|
| 52870 | 9/1910 | Switzerland | 30/445 |

*Primary Examiner*—Frank T. Yost
*Assistant Examiner*—Michael D. Folkerts
*Attorney, Agent, or Firm*—Kokjer, Kircher, Bradley, Wharton, Bowman & Johnson

[57] ABSTRACT

A tool for cutting the ends from spent cans of paint, solvents, or coatings so that the can wall can be easily flattened to facilitate disposal. The tool includes a handle having a hand grip on one end and a cutting head on the other end. The cutting head presents a special circular cutting blade having two sharp points and a tapered configuration between the points and a pair of valleys. A weighted sleeve which slides on the handle applies a driving force to the cutting head, causing the sharp points to pierce the can end followed by slicing action from the remainder of the cutting edge to cleanly sever the end of the can.

7 Claims, 1 Drawing Sheet

CAN END CUTTING DEVICE

BACKGROUND & SUMMARY OF THE INVENTION

This invention relates in general to the handling and disposal of empty containers and more particularly to a device which serves to cut the ends from empty cylindrical cans.

Due to the increased emphasis that has been placed on environmental concerns in recent years, persons and firms involved in the handling and disposal of waste materials have experienced dramatic increases in the difficulty and expense encountered in disposing of various types of waste materials. For example, the residual material that remains in expended metal containers which hold paint, solvents or coatings are in many cases considered hazardous materials by the federal and/or state regulatory bodies that have authority over activities that impact the environment. Consequently, the disposal of the expended containers must be carried out in accordance with procedures that are prescribed by such agencies.

The firms which are in the business of handling and disposing of hazardous waste commonly base their fees at least partially on the volume of the material, especially when transportation costs are involved (whether over land or water). Since the residue in the containers is actually the only material which is considered to be hazardous waste, and since it normally constitutes less than ten percent of the volume of the spent container, the disposal fee is based in large part on the ninety percent of the container volume which is empty. Therefore, it is apparent that the cost of disposing of hazardous waste materials of this type is much greater than it would be if the spent containers were collapsed. Further cost savings could be achieved because of the reduced storage space and reduced problems of handling that would result from the decreased size of the collapsed containers.

Because the bottoms normally remain on the cans, special power machinery is required to collapse them unless the bottoms are first removed. To my knowledge, there have been no manually operated devices available in the past which are practical for use in the cutting of the end from a rigid metal can. It is the principal goal of my invention to provide such a device.

More specifically, it is an important object of the invention to provide a device which functions to cut one or both ends from a cylindrical can so that the can wall can then be easily flattened in order to facilitate its disposal.

Another object of the invention is to provide a device of the character described which is operated manually and requires no external power source. This permits the device to be used in areas where electricity and other power sources are unavailable.

A further object of the invention is to provide a device of the character described which is easily operated and requires no special skills or training.

An additional object of the invention is to provide a device of the character described which is capable of cutting the ends from cans that vary in diameter. It is an important aspect of the invention that different size cutting heads can be used interchangeably with the same handle and weight, thus permitting the proper cutting head to be installed for the size of the container that is being processed.

Yet another object of the invention is to provide, in a device of the character described, a special cutting blade having a configuration to easily and cleanly sever the can end.

A still further object of the invention is to provide a device which is constructed economically and yet includes rugged and durable components that are able to withstand the considerable forces that are applied to them throughout the operating life of the device.

Other and further objects of the invention, together with the features of novelty appurtenant thereto, will appear in the course of the following description.

DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENTION

Figure 1:
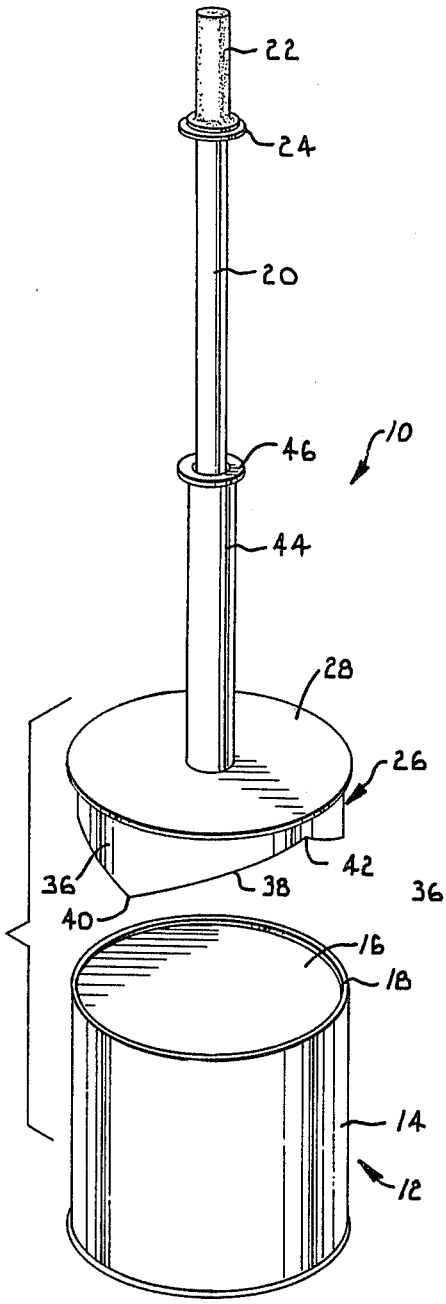
FIG. 1 is a perspective view of an inverted can and a can end cutting device constructed according to a preferred embodiment of the present invention.

Referring now to the drawing in more detail, numeral 10 generally designates a device which functions to cut the bottom and/or top ends from containers such as the rigid metal can designated generally by numeral 12. The can 12 is the type of container commonly used to hold paints, solvents, adhesives and various types of coating materials. The can may have virtually any capacity and is commonly a one gallon can, a five gallon can, a ten gallon can or another standard capacity can. The can 12 is empty except for a small amount of residual material that inevitably remains in the expanded can. The can 12 is shown in an inverted position and includes a cylindrical wall 14 and a discoidal bottom 16 which is secured to the wall. A circular bottom rim 18 is formed on the bottom edge of the wall 14 at a location adjacent to the bottom 16. The top of the can is initially covered by a lid (not shown) which is normally discarded when the contents of the can have been depleted.

It should be understood that the device of the present invention is useful to process cans which vary in their configuration and in their contents, and the device is not limited to use with any one type or style of can.

Device 10 includes an elongated cylindrical handle 20 which may be formed from a rigid pipe. A hand grip 22 is suitably secured on the upper end of the handle 20, and a flat washer 24 is welded to the handle at a location adjacent the lower end of the grip 22 in order to provide a stop, as will be explained more fully.

Figure 3:
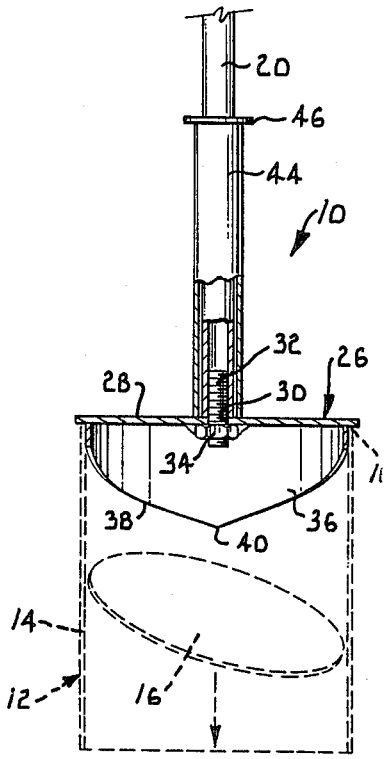
FIG. 3 is a fragmentary side elevational view similar to FIG. 2, but showing the device in its final position after having severed the bottom end of the can, with portions shown in section and the can and the severed can bottom shown in broken lines.
Figure 4:
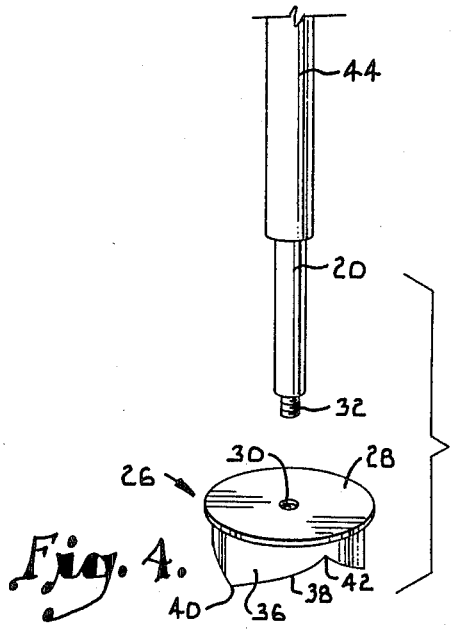
FIG. 4 is a fragmentary perspective view illustrating the manner in which the cutting head of the device is detachably secured to the handle.

Detachably secured to the opposite or lower end of handle 20 is a cutter which is generally designated by numeral 26. As will be more fully explained, cutters which differ in their size are used interchangeably with the handle 20. Each cutter includes a circular base plate 28 which takes the form of a metal disk. The diameter of the plate 28 is slightly greater than the diameter of the wall 14 of the can to which the cutter is applicable. As best shown in FIGS. 3 and 4, the plate 28 of each cutter has a central opening 30 which is large enough to closely receive a threaded rod 32 which is partially inserted in the lower end of handle 20. The threaded rod 32 projects beyond the lower end of the handle and is smaller in diameter than the handle. A threaded nut 34 is welded or otherwise secured to the lower surface of plate 28 at a location to register with the opening 30. By threading the rod 32 and nut 34 tightly together, the cutter 26 is securely yet detachably mounted on the lower end of handle 20.

Each cutter 26 includes a specially shaped cutting blade 36 which is preferably formed from thin stainless steel plate. The lower edge of the cutting blade 36 is a sharp cutting edge 38 which presents a pair of sharp points 40 at diametrically opposed locations on the cutting edge. The cutting edge 38 is generally circular and has a diameter slightly less than that of the can wall 14 so that the blade 36 can fit closely within the rim 18 and the can wall 14. The cutting edge 40 has a configuration to taper as it extends away from each of the sharp points 40, and the tapered sides of the cutting edge meet at a pair of diametrically opposed valleys 42 which are each offset 90° from the two points 40. The valleys 42 are located below plate 28 a distance greater than the distance between the rim 18 and the can bottom 16.

The cutting blade 36 may be formed by welding a pair of specially shaped plates end to end at one of the valleys 42, and then rolling the welded plate to the proper diameter circle and welding the otherends together at the other valley 42. The circular upper edge of blade 36 is welded to the lower surface of plate 28, and it is noted that the blade is recessed inwardly somewhat from the circular edge of the plate.

A weighted sleeve 44 is mounted for sliding movement on the handle 20. The sleeve 44 is preferably constructed from a thick wall pipe, and a flat washer is welded on the upper end of the sleeve to provide a flange 46. The sleeve 44 can slide upwardly on handle 20 until flange 46 contacts the washer 24. The sleeve can slide downwardly on the handle against plate 28.

It is contemplated that the device 10 will be provided with a plurality of interchangeable cutters 26, each having the proper size and shape to cut the bottom and/or top end from a can having a different capacity. For example, a small cutter 26 is provided for cutting the ends from one gallon cans, and a larger cutter 26 is provided for five gallon cans. Additional cutters may be provided for ten gallon cans and cans having other capacities.

Figure 2:
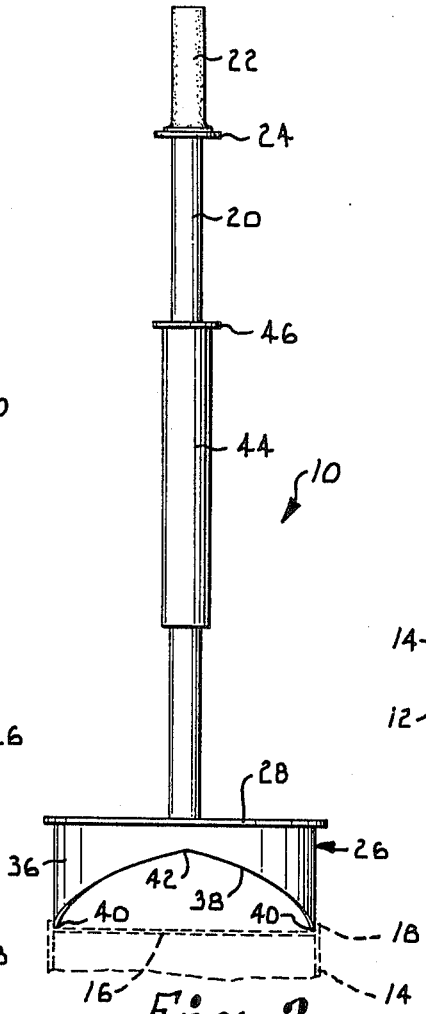
FIG. 2 is a side elevational view showing the device initially applied to the bottom of the inverted can, the latter being shown fragmentarily in broken lines.

In use, the cutter 26 having the proper size is secured on the end of handle 20 by threading the rod 32 and the nut 34 together until the bottom end of handle 20 is held tightly against the top surface of plate 28. Then, with the can 12 in an inverted position on a support surface, the cutting blade 36 is applied to the can bottom 16 such that the two points 40 rest on the bottom 16, as shown in FIG. 2. The hand grip 22 is held in one hand, and the weighted sleeve 44 is raised with the other hand and forcefully lowered to strike against the plate 28. The sleeve is raised again and forcefully driven against plate 28 repeatedly in this fashion until plate 28 rests on rim 18, at which time the blade 36 will have cut completely through the can bottom 16 in order to sever it from the can wall 14. As the weighted sleeve strikes plate 28, the points 40 initially pierce the can, and the remainder of the cutting edge subsequently cuts through the periphery of the can lid until it is eventually severed. When the plate 28 rests on top of rim 18, the bottom 16 will have been completely and cleanly severed from the can, and it then simply drops, as shown in FIG. 3. The can wall 14 can then be easily flattened, and the flattened can is easily stored, handled and disposed of.

The special tapered configuration of the cutting blade 36 provides slicing action which facilitates severing of the can bottom 16. Because of the pressure of the sharp points 40, the force initially applied to the can bottom 16 is connected at the two points, and they are thus able to initially pierce the can bottom without difficulty. Subsequent blows applied by the sleeve 44 cause the remaining portions of the cutting edge 38 to slice through the peripheral area of the can bottom 16, and the can bottom is thus gradually sliced away from the can wall 14 and is eventually completely severed.

Because the device is manually operated, there is no need for any electrical power or other external energy supply. At the same time the device can be operated simply without the need for special skills or training on the part of the operator. The components of the device are rugged, heavy duty materials which are able to stand up under the forces that are applied during use.

If a can having a different capacity is to have its bottom cut, the cutter 26 is simply threaded off of handle 20, and another cutter 26 having the proper size is secured on the end of the handle. The interchangeability of the cutters 26 allows virtually all cans having standard sizes to be processed without the need to provide a separate handle and a weighted sleeve for each different size.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A manually operated device for removing a discoidal end from a container having a generally cylindrical wall, said device comprising:

an elongate handle having opposite ends;

a planar circular metal plate mounted on one end of said handle with the handle being substantially perpendicular to the plane of the plate and generally centered thereon, said plate having a size to span the container wall at the end thereof adjacent the container end;

a cutting blade extending from said plate, said blade presenting a generally circular cutting edge having a size to fit closely within the container wall and a pair of diametrically opposed points, said cutting edge being tapered away from said points; and a weighted sleeve mounted on said handle for sliding movement thereon to be manually driven forcefully against said plate, thereby driving said cutting blade through the container end adjacent the container wall to cut the end from the wall, said sleeve having a lower end surrounding the handle and arranged to effect impact of the entirety of said lower end against said plate when the sleeve is driven against the plate.

2. A device as set forth in claim 1, including a hand grip on said handle on an end thereof opposite said one end.

3. A device as set forth in claim 1, including means for detachably securing said plate to said one end of the handle to permit replacement of the plate and blade as a unit.

4. A manually operated device for cutting ends from cylindrical containers having different diameters, said device comprising:

an elongate handle having opposite ends;

a plurality of cutters adapted for interchangeable mounting on one end of said handle, each cutter including a generally planar circular plate and a cutting blade extending from the plate and terminating in a sharp circular cutting edge, the plate for each cutter having a diameter greater than the diameter of the container to which the cutter is applicable and the blade for each cutter having a diameter to fit closely within the container;

means for detachably securing each cutter to said one end of the handle with the handle being substantially perpendicular to the plane of the plate of each cutter and generally centered thereon; and a weighted sleeve on said handle slidable thereon against the plate of each cutter which is secured on said one end of the handle, said sleeve having a lower end surrounding the handle and arranged to effect impact of the entirety of said lower end against said plate of each cutter when the sleeve is driven against the plate to apply a force for driving the blade through the periphery of the end of the container, said detachable securing means permitting the different cutters to be used interchangeably on the handle for application to containers having different diameters.

5. A device as set forth in claim 4, wherein said detachable securing means comprises:

a threadable rod on said one end of the handle, each plate having a central opening sized to closely receive the threaded rod in extension therethrough; and a nut secured to each plate adjacent the opening thereof for threaded application to the rod.

6. A device as set forth in claim 4, including a hand grip on said handle on an end thereof opposite said one end.

7. A device as set forth in claim 4, wherein:

the cutting edge of each blade includes a pair of sharp points at diametrically opposed locations on the edge; and the cutting edge of each blade tapers away from each of the points and includes a pair of diametrically opposed valleys each offset by approximately 90° from each of said points.

* * * * *